US012391454B2

(12) United States Patent
Wu

(10) Patent No.: US 12,391,454 B2
(45) Date of Patent: Aug. 19, 2025

(54) VACUUM CONTAINER

(71) Applicant: Jing-Feng Wu, Tainan (TW)

(72) Inventor: Jing-Feng Wu, Tainan (TW)

( * ) Notice: Subject to any disclaimer, the term of this patent is extended or adjusted under 35 U.S.C. 154(b) by 0 days.

(21) Appl. No.: 18/588,837

(22) Filed: Feb. 27, 2024

(65) Prior Publication Data

US 2024/0317478 A1 Sep. 26, 2024

(30) Foreign Application Priority Data

Mar. 23, 2023 (TW) ..... 112110818

(51) Int. Cl.
*B65D 81/20* (2006.01)
*B65D 43/02* (2006.01)

(52) U.S. Cl.
CPC ..... *B65D 81/2038* (2013.01); *B65D 43/0218* (2013.01); *B65D 2543/00203* (2013.01); *B65D 2543/00231* (2013.01); *B65D 2543/005* (2013.01); *B65D 2543/00537* (2013.01); *B65D 2543/00555* (2013.01)

(58) Field of Classification Search
CPC ..... B65D 81/2038; B65D 43/0218; B65D 2543/00203; B65D 2543/00231; B65D 2543/005; B65D 2543/00537; B65D 2543/00555; B65B 31/047; F16J 13/24
USPC ... 220/231, 212, 240, 203.11, 367.1, 203.29, 220/203.01, 203.13; 215/228, 262, 260, 215/270, 311; 141/8, 65, 98; 206/524.8, 206/459.1; 99/472, 454
See application file for complete search history.

(56) References Cited

U.S. PATENT DOCUMENTS 1,672,904 A * 6/1928 Randall ..... B65D 81/3818 220/592.27
3,129,835 A * 4/1964 Collens ..... F04B 43/0063 215/311
4,051,971 A * 10/1977 Saleri ..... B65D 81/2038 99/476
4,083,468 A * 4/1978 Batchelor ..... B65D 39/12 220/234
4,218,967 A * 8/1980 Batchelor ..... B65D 81/2038 206/524.8
4,372,096 A * 2/1983 Baum ..... B67B 3/24 53/103

(Continued)

FOREIGN PATENT DOCUMENTS

CN 2616493 Y * 5/2004
WO WO-2012114277 A1 * 8/2012 ..... A47J 36/027

*Primary Examiner* — Orlando E Aviles
*Assistant Examiner* — Brijesh V. Patel
(74) *Attorney, Agent, or Firm* — HESLIN, ROTHENBERG, FARLEY & MESITI, P.C.; George S. Blasiak, Esq.

(57) ABSTRACT

The invention discloses a vacuum container comprising a storage container, a connecting tray component, a top cap and two one-way exhausters. The connecting tray component air-tightly encloses a container opening of the storage container. The top cap has a pressing part, and the top cap encloses a tray opening of the connecting tray component in a manner that the pressing part is in a position corresponding to the tray opening. One of the one-way exhausters is inserted in a guiding hole of the connecting tray component to form a tray one-way exhaust passage. The other one-way exhauster is inserted in an exhausting hole to form a cap one-way exhaust passage.

10 Claims, 6 Drawing Sheets

(56) References Cited

U.S. PATENT DOCUMENTS 4,807,776 A * 2/1989 Cortopassi ..... B65D 43/0212 220/528
4,823,968 A * 4/1989 Handzlik ..... B65B 31/047 215/260
5,390,809 A * 2/1995 Lin ..... F16K 15/1825 220/592.27
5,398,811 A * 3/1995 Latella, Jr. ..... A47J 47/04 206/524.8
5,406,992 A * 4/1995 Miramon ..... A47G 19/2272 220/203.02
5,469,979 A * 11/1995 Chiou ..... B65D 81/2038 220/625
5,546,997 A * 8/1996 Miramon ..... B65D 81/20 53/88
5,558,243 A * 9/1996 Chu ..... B65D 81/2038 220/240
5,564,480 A * 10/1996 Chen ..... A47J 47/06 220/203.02
5,564,581 A * 10/1996 Lin ..... B65D 81/2038 215/228
5,611,376 A * 3/1997 Chuang ..... B65B 31/047 215/311
5,651,470 A * 7/1997 Wu ..... F16J 13/24 220/240
5,692,632 A * 12/1997 Hsieh ..... B65D 81/20 220/240
5,806,575 A * 9/1998 Tsay ..... B65D 81/2015 141/192
5,944,211 A * 8/1999 Woodnorth ..... B65D 81/2038 220/806
5,957,317 A * 9/1999 Lee ..... B65D 81/2038 220/240
6,023,915 A * 2/2000 Colombo ..... B65D 77/225 426/106
6,264,054 B1 * 7/2001 Miyake ..... B65D 81/2038 220/23.91
6,619,493 B2 * 9/2003 Yang ..... B65D 51/1683 220/203.11
6,644,489 B2 * 11/2003 Chang ..... B65D 81/2038 215/311
6,789,690 B2 * 9/2004 Nieh ..... B65D 81/2015 220/203.11
6,830,081 B1 * 12/2004 Chen ..... F04B 35/04 220/203.19
6,877,629 B2 * 4/2005 Meyer ..... A47J 47/10 206/524.8
6,994,227 B2 * 2/2006 Kwon ..... A47J 47/10 220/203.11
7,048,136 B2 * 5/2006 Havens ..... B65D 51/1644 222/509
7,296,598 B2 * 11/2007 Lin ..... B65D 81/2038 220/240
7,299,941 B2 * 11/2007 McMahon, III ... B65D 43/0222 220/780
7,614,522 B2 * 11/2009 Hsu ..... A47J 36/027 220/784
8,186,527 B2 * 5/2012 Liu ..... B65D 39/12 215/354
8,590,722 B2 * 11/2013 Kim ..... B65D 81/2038 277/530
9,108,778 B2 * 8/2015 Wang ..... B65D 51/165
9,145,242 B2 * 9/2015 Wang ..... A47J 47/06
9,731,887 B2 * 8/2017 Park ..... B65D 81/2015
9,771,200 B2 * 9/2017 Sun ..... B65D 25/28
10,597,217 B2 * 3/2020 Krus ..... B65D 81/2038
10,968,025 B2 * 4/2021 Wei ..... B65D 81/2015
11,021,311 B2 * 6/2021 Pace ..... A47J 41/02
11,370,592 B2 * 6/2022 Wang ..... B65D 51/1644
2003/0116572 A1 * 6/2003 Klock ..... A47J 36/027 220/373
2005/0051551 A1 * 3/2005 Galletti ..... B65D 81/2038 220/212
2008/0078466 A1 * 4/2008 Wang ..... B65D 81/2038 141/65
2008/0110911 A1 * 5/2008 Chen ..... B65D 45/32 220/793
2010/0263328 A1 * 10/2010 Dorsey ..... B65D 81/2015 220/8
2013/0146500 A1 * 6/2013 Kim ..... B65D 81/2038 206/524.8
2020/0039724 A1 * 2/2020 Park ..... B65D 43/0222
2021/0284398 A1 * 9/2021 Valderrama ..... B65D 43/022

* cited by examiner

VACUUM CONTAINER

CROSS REFERENCE TO RELATED APPLICATIONS

This application claims priority to Taiwanese Application No. 112110818, filed on Mar. 23, 2023, which is incorporated by reference herein in its entirety.

FIELD OF THE INVENTION

The present invention relates to a vacuum container, and more particularly relates to a vacuum container which is simple in structure and easy to operate.

BACKGROUND OF THE INVENTION

A conventional vacuum container for preserving foods is usually equipped with a vacuum pump to exhaust inside air to the outside of the vacuum container, thereby creating a vacuum state inside the vacuum container for food preservation. However, the disposing of the vacuum pump not only increases the assembly cost of the vacuum container but also complicates the whole structure by requiring the disposing of corresponding airtight flow paths to cause that the conventional vacuum container is not conducive to detachment and cleaning.

SUMMARY OF THE INVENTION

Therefore, one objective of the present invention is to provide a vacuum container which is conducive to detachment and cleaning and easy to operate to achieve/release the vacuum state.

In order to achieve the above objective, the present invention provides a vacuum container, comprising: a storage container having a container opening and an accommodating space communicating with each other, wherein the container opening is formed on a top portion of the storage container such that an object to be preserved passes through the container opening to get into the accommodating space; a connecting tray component having a tray opening, a tray inside space and a guiding hole, wherein the tray opening is formed on a top portion of the connecting tray component and communicates with the tray inside space, the guiding hole is formed passing through the connecting tray component, and the connecting tray component air-tightly encloses the container opening to seal the accommodating space; a top cap having a pressing part, wherein the top cap is flexible such that the top cap is pressed to collapse and deform, the top cap encloses the tray opening to seal the tray inside space in a manner that the pressing part is in a position corresponding to the tray opening of the connecting tray component, and the top cap has an exhausting hole passing through the top cap; and two one-way exhausters, wherein one of the one-way exhausters is inserted in the guiding hole to mount in the connecting tray component thereby forming a tray one-way exhaust passage communicating the accommodating space of the storage container and the tray inside space of the connecting tray component, and another one-way exhauster is inserted in the exhausting hole to mount in the top cap thereby forming a cap one-way exhaust passage communicating the tray inside space and an outside space; wherein when the pressing part of the top cap is pressed to collapse and deform toward the tray inside space, the tray inside space is compressed by the pressing part and exhausts an exhaust air through the cap one-way exhaust passage to the outside space, and then the accommodating space is driven by a pressure difference between the tray inside space and the accommodating space to exhaust through the tray one-way exhaust passage to the tray inside space so that the accommodating space becomes in a state approaching vacuum, and the pressing part resiliently recovers due to an intake air to the tray inside space.

In one embodiment of the present invention, a vacuum container is provided, wherein the connecting tray component has a connecting ring, a spacer tray and a top ring, the connecting ring is ring-shaped and has a down extending part and a receiving part, the down extending part is formed extending from a bottom portion of the connecting ring in a circular manner, the receiving part is arranged at a top portion of the connecting ring, the receiving part is in position corresponding to the top portion of the storage container, and the down extending part is in tight contact with an inner surface of the storage container so that the connecting ring is air-tightly mounted on the top portion of the storage container, the tray opening is formed on a top portion of the spacer tray, the tray inside space is formed inside the spacer tray, the guiding hole is formed passing through a bottom base of the spacer tray thereby mounting the one-way exhauster in the guiding hole, and the spacer tray has a contact part, the contact part is ring-shaped and disposed between the top portion of the spacer tray and the bottom base to form a stair like structure together with the top portion of the spacer tray and the bottom base, wherein the contact part is in tight contact with the receiving part of the connecting ring, and an outer surface of the spacer tray is arranged opposite to an inner surface of the connecting ring, and the outer surface of the spacer tray is arranged between the contact part and the bottom base, the top portion of the top ring is in tight contact with the top ring, and a bottom surface of the top cap is in tight contact with the top portion of the spacer tray, wherein the bottom portion of the connecting ring is in airtight contact with the top portion of the storage container to air-tightly enclose the container opening of the storage container with the spacer tray and the top ring, when the connecting ring is pulled in a manner away from the top portion of the storage container, an outside air from the outside space flows into the accommodating space.

In one embodiment of the present invention, a vacuum container is provided, wherein the connecting ring of the connecting tray component further has a holding tab, the holding tab is formed extending downward from an outer surface of the connecting ring, and the holding tab is provided to be held to facilitate pulling the connecting ring away from the top portion of the storage container.

In one embodiment of the present invention, a vacuum container is provided, wherein the connecting ring of the connecting tray component further has a through hole, the through hole is formed passing through the down extending part so that two ends of the through hole are in a position corresponding to the inner surface of the storage container and the spacer tray, respectively so that the outside air in advance passes through the through hole to flow into the accommodating space of the storage container when the connecting ring is pulled upward slightly thereby preventing from pulling upward the connecting ring too high.

In one embodiment of the present invention, a vacuum container is provided, wherein the top ring of the connecting tray component further has an extensional part, the extensional part is ring-shaped and formed extending downward from a bottom portion of the top ring to dispose in a top inner surface of the spacer tray, the top cap further has a bottom extending part, the bottom extending part is ring-shaped and is formed protruding from the bottom surface of the top cap, and the bottom extending part further has a plurality of transverse strips, the transverse strips are arranged to be spaced apart from each other and transversely protrude from an outer surface of the bottom extending part, wherein the bottom surface of the top cap, which abuts to a rim of the top cap, is in tight contact with a top surface of the top ring, the bottom extending part of the top cap is in tight contact with an inner surface of the top ring, and the transverse strips are in tight contact with the extensional part of the top ring thereby forming an airtight connection between the top ring and the top cap.

In one embodiment of the present invention, a vacuum container is provided, wherein the spacer tray of the connection tray component has a plurality of guiding grooves, the guiding grooves are recessed from a bottom outer surface of the spacer tray in a radially spaced manner around the guiding hole, the guiding grooves communicate with the accommodating space of the storage container, the one-way exhauster mounted in the spacer tray has a cylinder, a bottom contact block, a top cover part and a membrane, the cylinder is inserted in the guiding hole of the spacer tray, a flowing clearance is formed between an outer surface of the cylinder and the bottom base of the spacer tray, and the flowing clearance communicates with the guiding grooves, the bottom contact block is arranged at a bottom portion of the cylinder and in contact with the bottom outer surface of the spacer tray to cover the guiding grooves, the top cover part is arranged at a top portion of the cylinder and disposed in the tray inside space of the spacer tray, the membrane is formed extending downward from a rim of the top cover part and at an inclined angle to the top cover part, and is in airtight contact with a bottom inner surface of the spacer tray, thereby forming, together with the spacer tray and the top cover part, a temporary chamber communicating with the flowing clearance, wherein the intake air from the accommodating space driven by the pressure difference between the tray inside space and the accommodating space flows through the guiding grooves, the flowing clearance and the temporary chamber and pushes the membrane away from the bottom inner surface of the spacer tray to open the tray one-way exhaust passage so that the intake air can flow to the tray inside space, after the intake air flows through the membrane, the membrane recovers to have an airtight contact with the bottom inner surface of the spacer tray to block the intake air from flowing back to the accommodating space.

In one embodiment of the present invention, a vacuum container is provided, wherein the top cap has a plurality of exhausting grooves, the exhausting grooves are recessed from a bottom surface of the top cap in a radially spaced manner around the exhausting hole, the exhausting grooves communicate with the tray inside space of the spacer tray, the one-way exhauster mounted in the top cap has a cylinder, a bottom contact block, a top cover part and a membrane, the cylinder is inserted in the exhausting hole of the top cap, a flowing clearance is formed between an outer surface of the cylinder and the top cap, and the flowing clearance communicates with the exhausting grooves, the bottom contact block is arranged at a bottom portion of the cylinder and in contact with the bottom surface of the top cap to cover the exhausting grooves, the top cover part is arranged at a top portion of the cylinder and disposed between the exhausting hole and the outside space, the membrane extends downward from a rim of the top cover part in an inclined angle with respect to the top cover part, and is in airtight contact with a top surface of the top cap, and the membrane is together with the top cap and the top cover part to form a temporary chamber communicating with the flowing clearance, wherein the exhaust air from the tray inside space compressed by the pressing part of the top cap flows through the exhausting grooves, the flowing clearance and the temporary chamber and pushes the membrane away from the top surface of the top cap to open the cap one-way exhaust passage so that the exhaust air can flow to the outside space, after the exhaust air flows through the membrane, the membrane recovers to have an airtight contact with the top surface of the top cap to block the outside air flowing back to the tray inside space.

In one embodiment of the present invention, a vacuum container is provided, wherein the top cap further has a spacer groove, the spacer groove is recessed in the top cap and is formed to surround, together with the exhausting hole, the pressing part so that the pressing part of the top cap is easy to collapse and deform by pressing the pressing part.

In one embodiment of the present invention, a vacuum container is provided, wherein the top cap has a vent hole, the vent hole is formed through the top cap and located in the pressing part, the vent hole communicates with the outside space and the tray inside space, wherein by pressing the top cap while blocking the vent hole, the top cap collapses to deform so as to exhaust the exhaust air to the outside space by compression of the tray inside space, after releasing the pressing operation of the pressing part, the vent hole is open and the tray inside space will have an atmospheric pressure the same as the outside space.

The vacuum container of the present invention has the technical effects as follows. The vacuum container has a simple structure so that the vacuum container is easy to disassemble and assemble for cleaning. Moreover, it is easy to operate the vacuum container to achieve the vacuum state, and also easy to operate the vacuum container to release the vacuum state.

DETAILED DESCRIPTION OF THE PREFERRED EMBODIMENTS

The preferred embodiments of the present invention are described in detail with reference to FIGS. 1 to 6. The description is used for explaining the embodiments of the present invention only, but not for limiting the scope of the claims.

Figure 1:
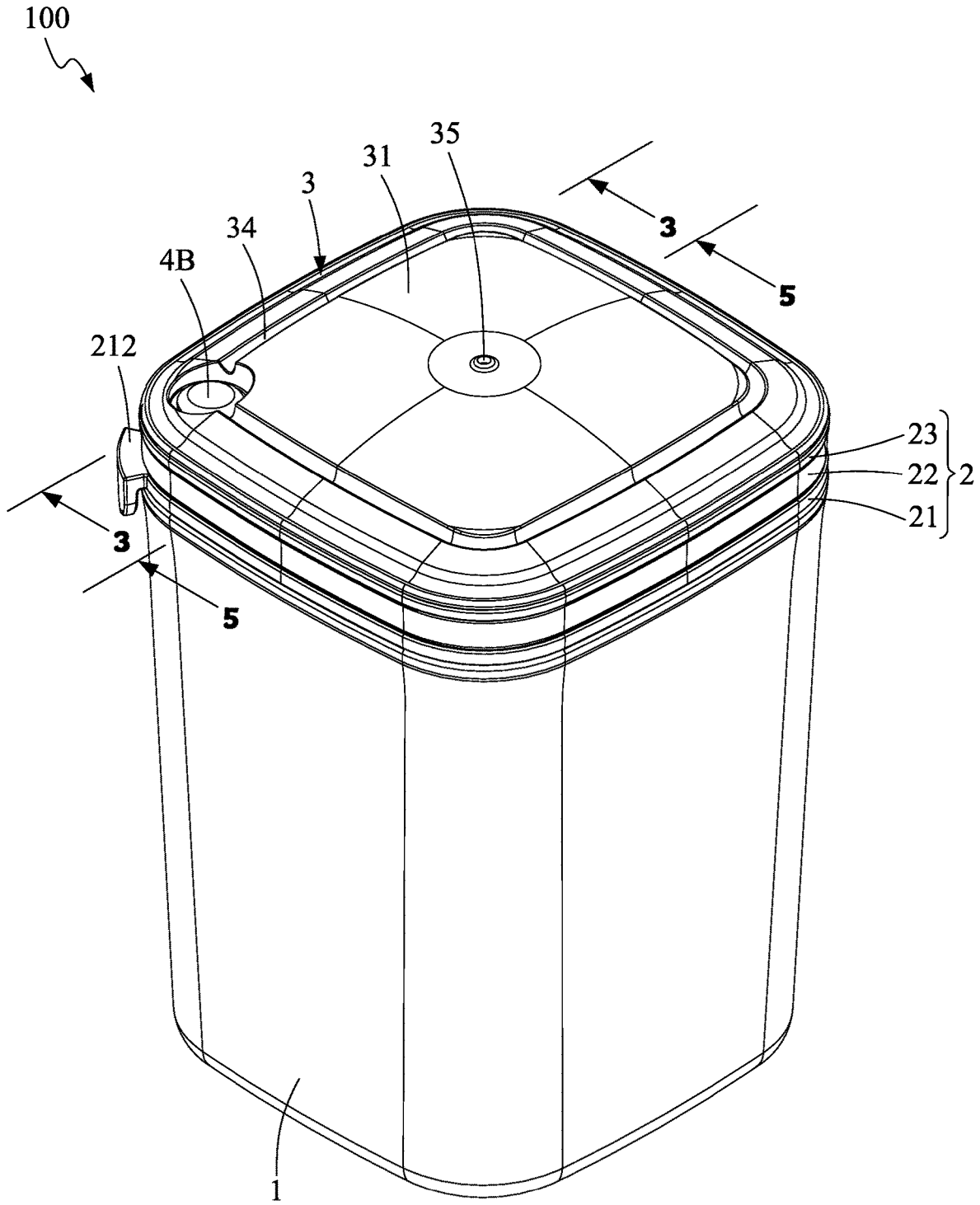
FIG. 1 is a schematic diagram illustrating an appearance of a vacuum container according to one embodiment of the present invention.
Figure 2:
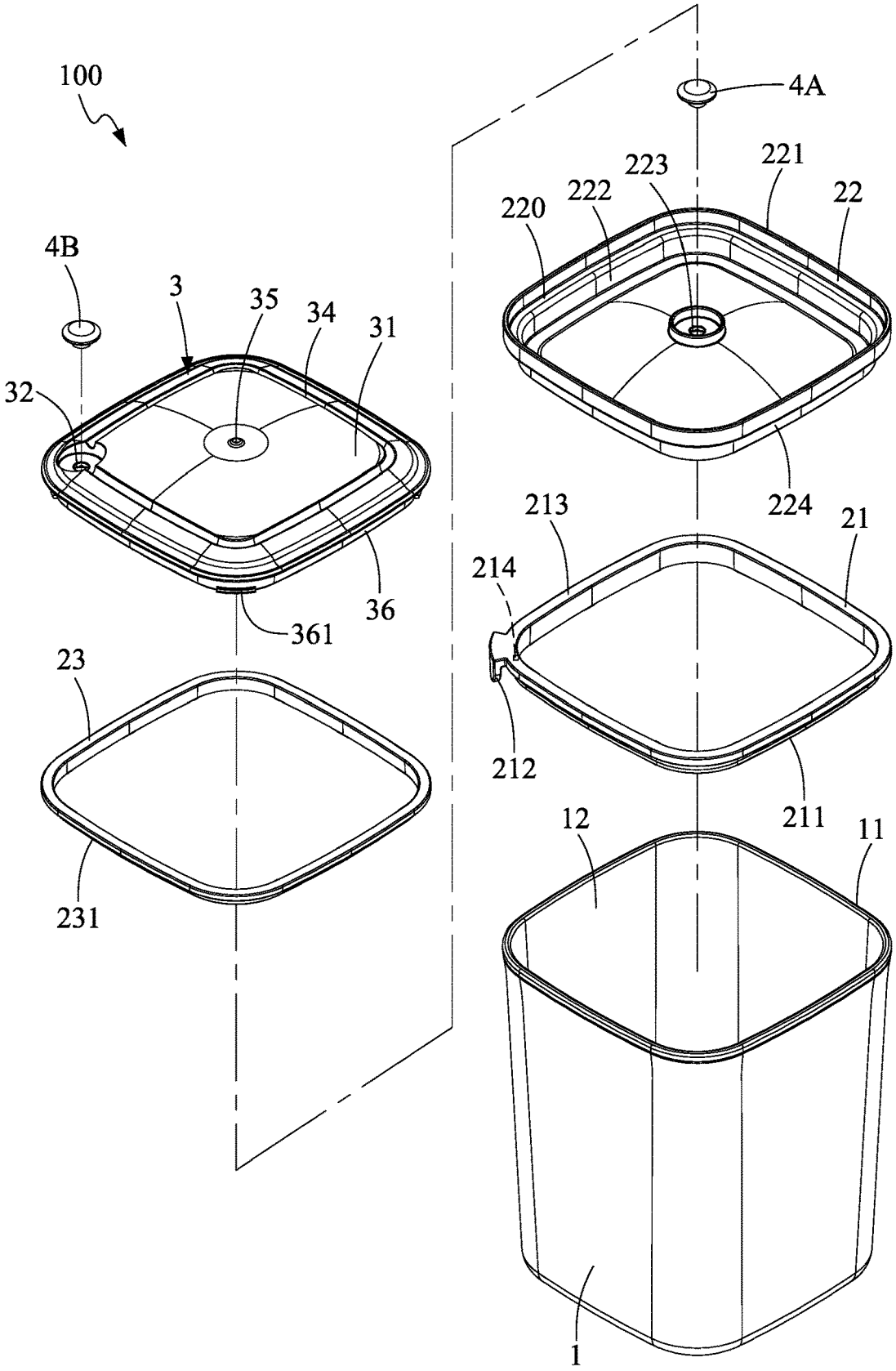
FIG. 2 is a schematic exploded view illustrating the vacuum container according to the embodiment of the present invention.
Figure 3:
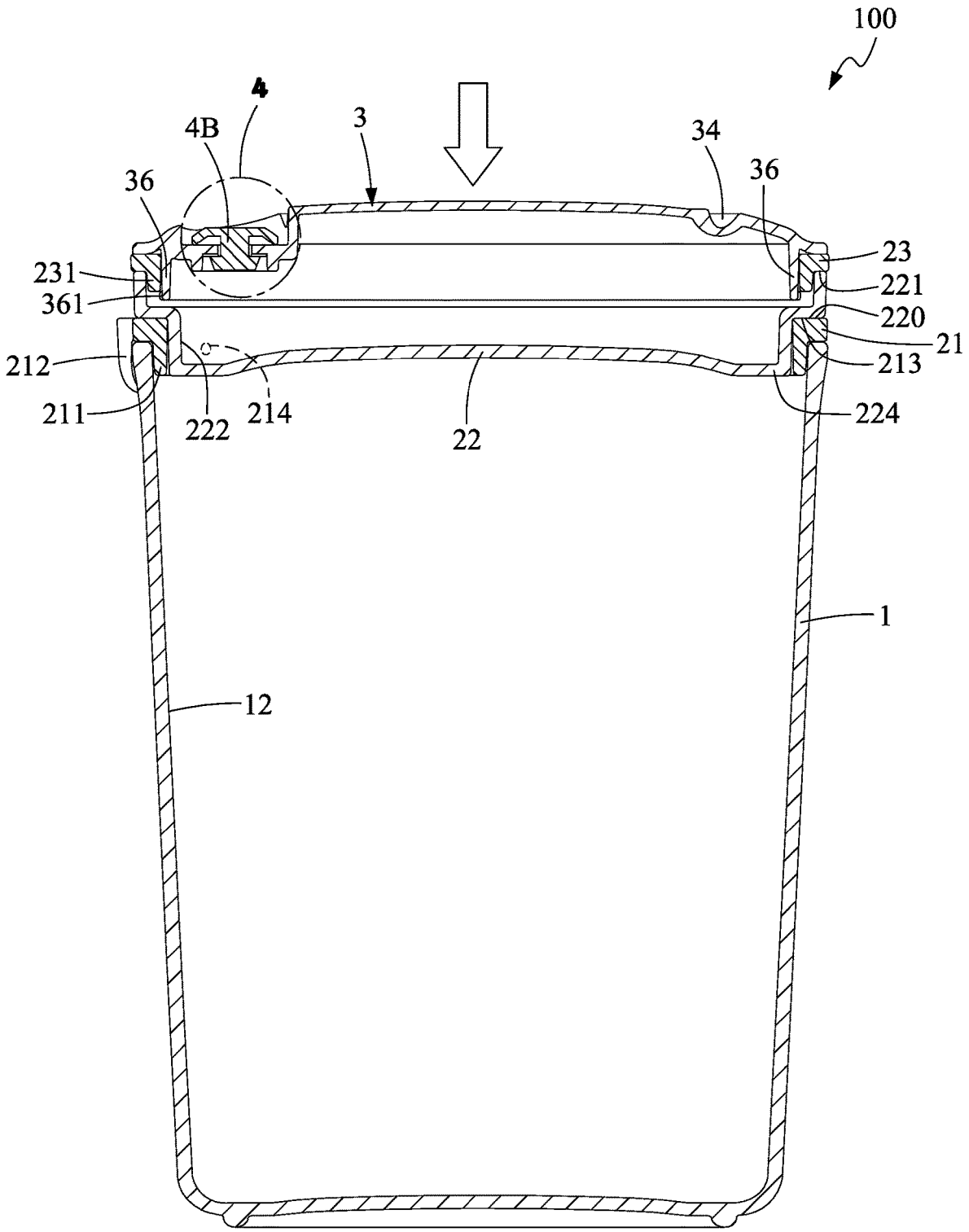
FIG. 3 is a schematic sectional view illustrating the vacuum container according to the embodiment of the present invention along line 3-3 in FIG. 1.

As shown in FIGS. 1 to 3, a vacuum container 100 according to one embodiment of the present invention has a storage container 1, a connecting tray component 2, a top cap 3 and two one-way exhausters 4A, 4B. The vacuum container 100 of the present invention has a simple structure so that the vacuum container 100 is easy to disassemble and assemble for cleaning. Moreover, it is easy to operate the vacuum container 100 to achieve the vacuum state and to release the vacuum state, thus facilitating users to operate the vacuum container 100.

As shown in FIGS. 1 to 3, the storage container 1 has a container opening 11 and an accommodating space 12 communicating with each other. The container opening 11 is formed on a top portion of the storage container 1 such that an object to be preserved passes through the container opening 11 to get into the accommodating space 12.

As shown in FIGS. 1 to 3, the connecting tray component 2 has a tray opening 221, a tray inside space 222 and a guiding hole 223. The tray opening 221 is formed on a top portion of the connecting tray component 2 and communicates with the tray inside space 222. The guiding hole 223 is formed passing through the connecting tray component 2. The connecting tray component 2 air-tightly encloses the container opening 11 to seal the accommodating space 12.

As shown in FIGS. 1 to 3, the top cap 3 has a pressing part 31. The top cap 3 is flexible such that the top cap 3 is pressed to collapse and deform. The top cap 3 encloses the tray opening 221 to seal the tray inside space 222 in a manner that the pressing part 31 is in a position corresponding to the tray opening 221 of the connecting tray component 2. Moreover, the top cap 3 has an exhausting hole 32 passing through the top cap 3.

Figure 5:
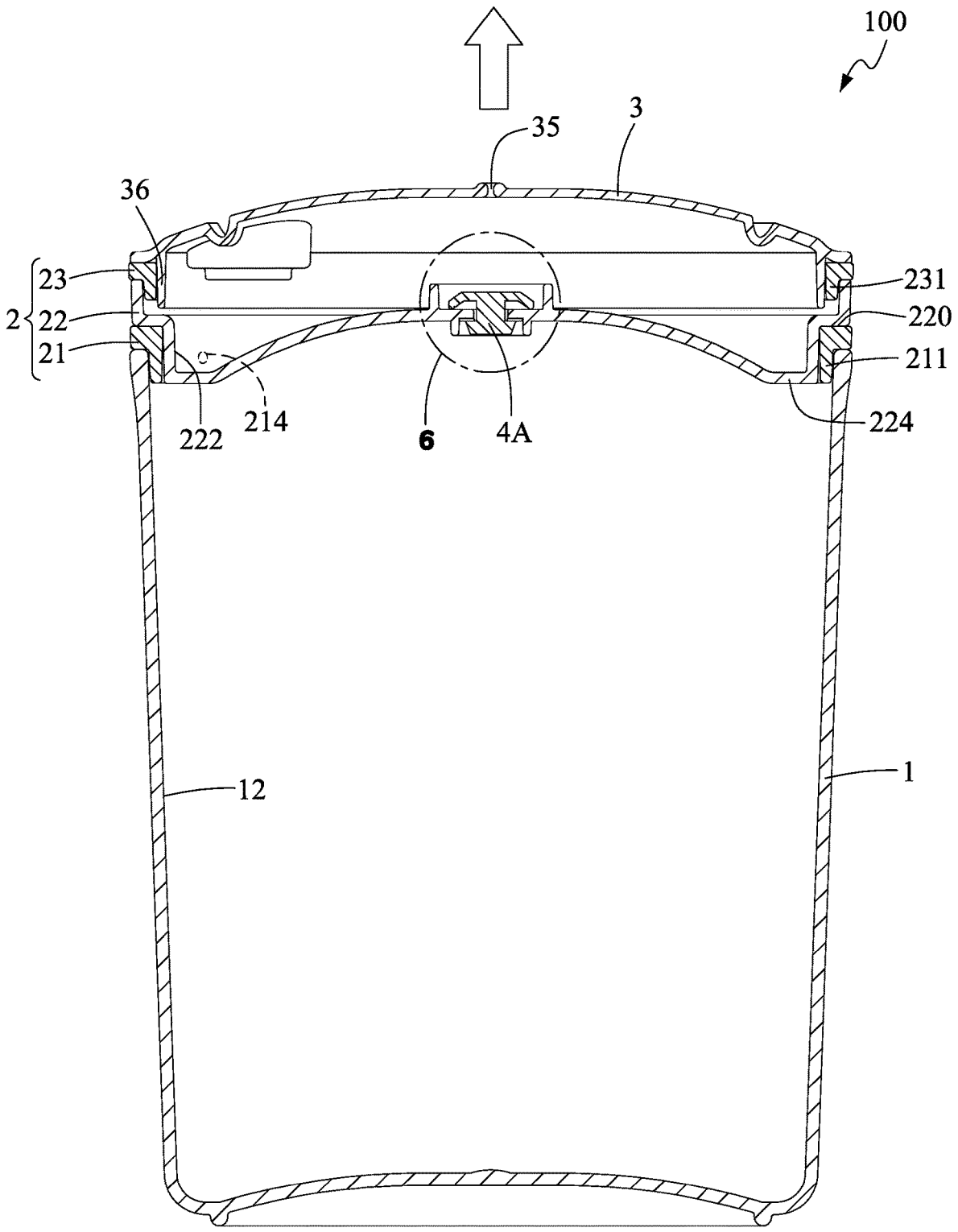
FIG. 5 is a schematic sectional view illustrating the vacuum container according to the embodiment of the present invention along line 5-5 in FIG. 1.
Figure 6:
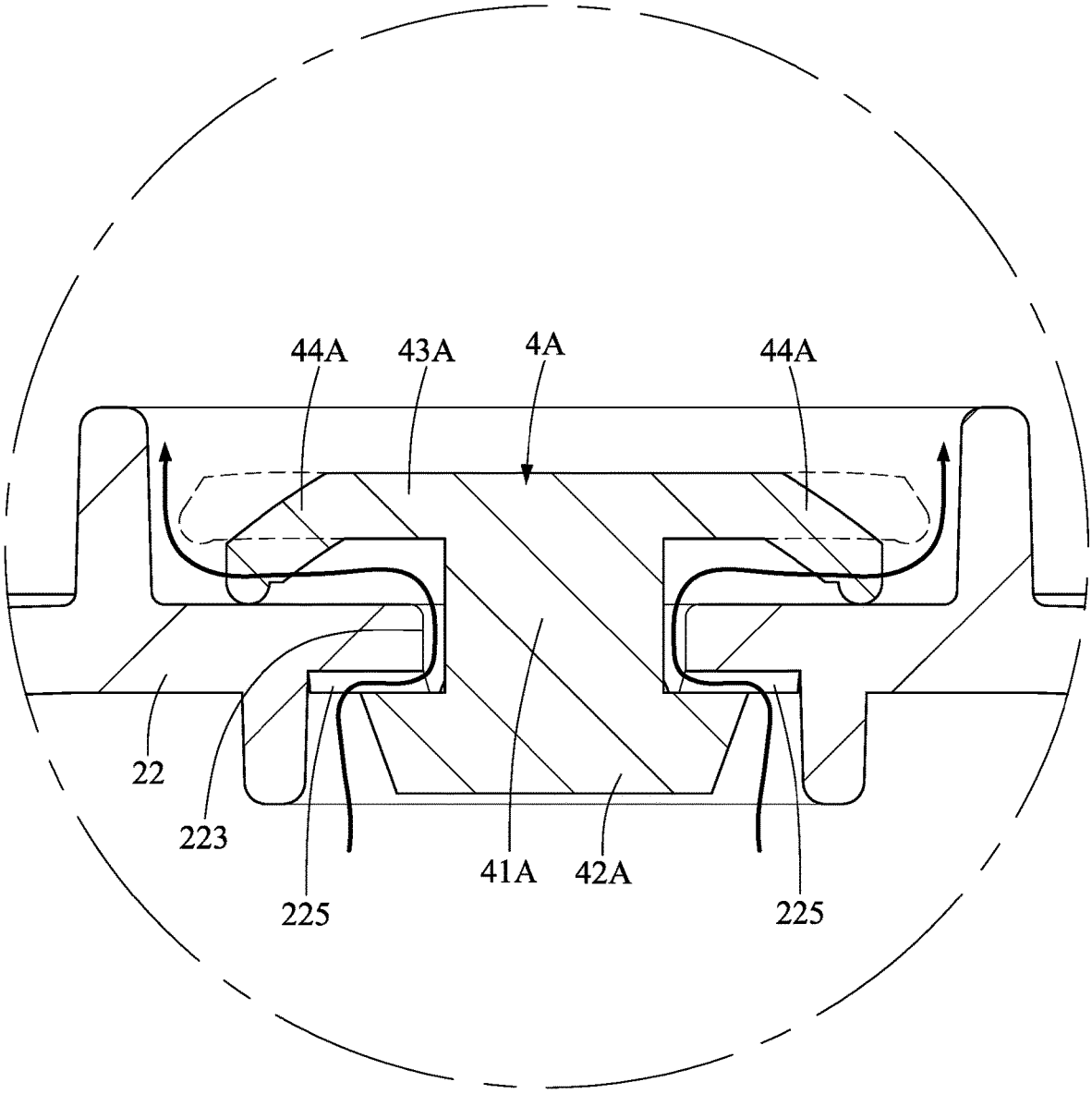
FIG. 6 is a schematic enlarged view illustrating the vacuum container according to the embodiment of the present invention in an area denoted by reference numeral 6 in FIG. 5.

As shown in FIGS. 1, 5 and 6, one of the one-way exhausters 4A is inserted in the guiding hole 223 to mount in the connecting tray component 2 thereby forming a tray one-way exhaust passage. The tray one-way exhaust passage communicates the accommodating space 12 of the storage container 1 and the tray inside space 222 of the connecting tray component 2.

Figure 4:
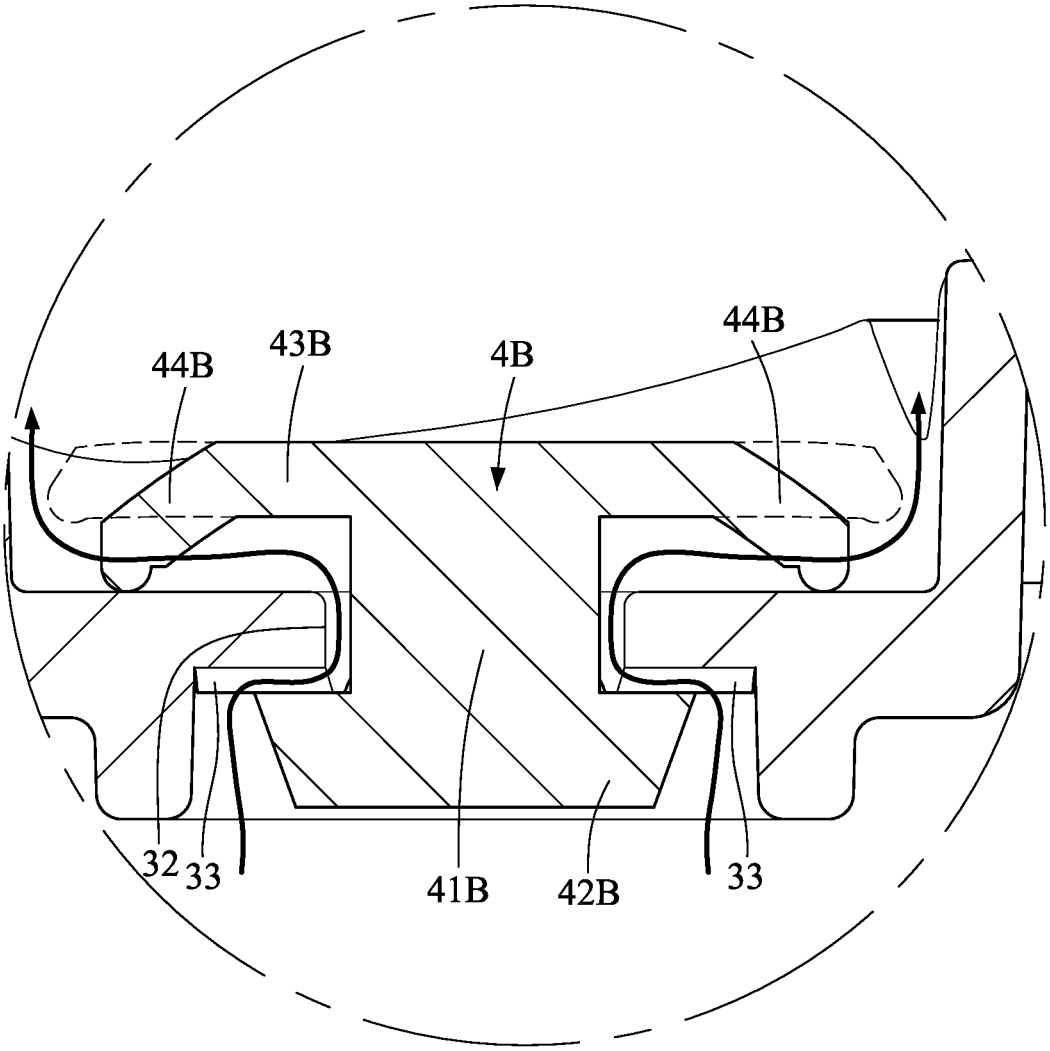
FIG. 4 is a schematic enlarged view illustrating the vacuum container according to the embodiment of the present invention in an area denoted by reference numeral 4 in FIG. 3.

As shown in FIGS. 1, 3 and 4, the other one-way exhauster 4B is inserted in the exhausting hole 32 to mount in the top cap 3 thereby forming a cap one-way exhaust passage. The cap one-way exhaust passage communicates the tray inside space 222 and an outside space.

In the embodiment of the prevent invention, as shown in FIGS. 1, 3 and 4, when the pressing part 31 of the top cap 3 is pressed to collapse and deform toward the tray inside space 222, the tray inside space 222 is compressed by the pressing part 31 and exhausts an exhaust air through the cap one-way exhaust passage to the outside space. With reference to FIGS. 1, 5 and 6, the accommodating space 12 is then driven by a pressure difference between the tray inside space 222 and the accommodating space 12 to exhaust through the tray one-way exhaust passage to the tray inside space 222 so that the accommodating space 12 becomes in a state approaching vacuum, and the pressing part 31 resiliently recovers due to an intake air to the tray inside space 222.

In detail, as shown in FIGS. 1 to 3, according to the vacuum container 100 of the present invention, the connecting tray component 2 has a connecting ring 21, a spacer tray 22 and a top ring 23. The connecting ring 21 is ring-shaped and has a down extending part 211 and a receiving part 213. The down extending part 211 is formed extending downward from a bottom portion of the connecting ring 21 in a circular manner. The receiving part 213 is arranged at a top portion of the connecting ring 21. The receiving part 213 is in position corresponding to the top portion of the storage container 1, and the down extending part 211 is in tight contact with an inner surface of the storage container 1 so that the connecting ring 21 is air-tightly mounted on the top portion of the storage container 1. In detail, the bottom portion of the connecting ring 21 is in airtight contact with the top portion of the storage container 1 to air-tightly enclose the container opening 11 of the storage container 1 with the spacer tray 22 and the top ring 23. When the connecting ring 21 is pulled in a manner away from the top portion of the storage container 1, an outside air from the outside space flows into the accommodating space 12.

As shown in FIGS. 1, 2, 5 and 6, the tray opening 221 is formed on a top portion of the spacer tray 22, the tray inside space 222 is formed inside the spacer tray 22, the guiding hole 223 is formed passing through a bottom base 224 of the spacer tray 22 thereby mounting the one-way exhauster 4A in the guiding hole 223. Moreover, the spacer tray 22 has a contact part 220, the contact part 220 is ring-shaped and disposed between the top portion of the spacer tray 22 and the bottom base 224 to form a stair like structure together with the top portion of the spacer tray 22 and the bottom base 224. The contact part 220 is in tight contact with the receiving part 213 of the connecting ring 21, and an outer surface of the spacer tray 22 is arranged opposite to an inner surface of the connecting ring 21, wherein the outer surface of the spacer tray 22 is arranged between the contact part 220 and the bottom base 224.

As shown in FIGS. 1 to 3, according to the vacuum container 100 of the present invention, the connecting ring 21 of the connecting tray component 2 further has a holding tab 212. The holding tab 212 is formed extending downward from an outer surface of the connecting ring 21. The holding tab 212 is provided to be held to facilitate pulling the connecting ring 21 away from the top portion of the storage container 1.

As shown in FIGS. 2 and 3, the connecting ring 21 of the connecting tray component 2 further has a through hole 214. The through hole 214 is formed passing through the down extending part 211 so that two ends of the through hole 214 are in position corresponding to the inner surface of the storage container 1 and the spacer tray 22, respectively so that the outside air earlier passes through the through hole 214 to flow into the accommodating space 12 of the storage container 1 when the connecting ring 21 is pulled upward slightly thereby preventing from pulling upward the connecting ring 21 too high and causing damage to the connecting ring 21 due to tension. Furthermore, the through hole 214 may be in position corresponding to the holding tab 212.

As shown in FIGS. 1 to 3, the top portion of the top ring 23 is in tight contact with the top cap 3, and a bottom surface of the top ring 23 is in tight contact with the top portion of the spacer tray 22. According to the vacuum container 100 of the embodiment of the present invention, the top ring 23 of the connecting tray component 2 further has an extensional part 231. The extensional part 231 is ring-shaped and formed extending downward from a bottom portion of the top ring 23 to dispose in a top inner surface of the spacer tray 22.

Furthermore, as shown in FIGS. 1 to 3, the top cap 3 further has a bottom extending part 36, the bottom extending part 36 is ring-shaped and is formed protruding from the bottom surface of the top cap 3. Moreover, the bottom extending part 36 further has a plurality of transverse strips 361, the transverse strips 361 are arranged to be spaced apart from each other and transversely protrude from an outer surface of the bottom extending part 36. The bottom surface of the top cap 3, which abuts to a rim of the top cap 3, is in tight contact with a top surface of the top ring 23, and the bottom extending part 36 of the top cap 3 is in tight contact with an inner surface of the top ring 23. Furthermore, the transverse strips 361 are in tight contact with the extensional part 231 of the top ring 23 thereby forming an airtight connection between the top ring 23 and the top cap 3.

As shown in FIGS. 1, 2, 5 and 6, according to the vacuum container 100 of the embodiment of the present invention, the spacer tray 22 of the connection tray component 2 has a plurality of guiding grooves 225. The guiding grooves 225 are recessed from a bottom outer surface of the spacer tray 22 in a radially spaced manner around the guiding hole 223. The guiding grooves 225 communicate with the accommodating space 12 of the storage container 1.

In detail, as shown in FIGS. 1, 2, 5 and 6, the one-way exhauster 4A mounted in the spacer tray 22 has a cylinder 41A, a bottom contact block 42A, a top cover part 43A and a membrane 44A. The cylinder 41A is inserted in the guiding hole 223 of the spacer tray 22, a flowing clearance is formed between an outer surface of the cylinder 41A and the bottom base of the spacer tray 22, and the flowing clearance communicates with the guiding grooves 225. The bottom contact block 42A is arranged at a bottom portion of the cylinder 41A and in contact with the bottom outer surface of the spacer tray 22 to cover the guiding grooves 225. The top cover part 43A is arranged at a top portion of the cylinder 41A and disposed in the tray inside space 222 of the spacer tray 22. The membrane 44A is formed extending downward from a rim of the top cover part 43A and at an inclined angle to the top cover part 43A, and is in airtight contact with a bottom inner surface of the spacer tray 22, thereby forming, together with the spacer tray 22 and the top cover part 43A, a temporary chamber communicating with the flowing clearance.

As shown in FIGS. 1, 2, 5 and 6, the intake air from the accommodating space 12 driven by the pressure difference between the tray inside space 222 and the accommodating space 12 flows through the guiding grooves 225, the flowing clearance and the temporary chamber and pushes the membrane 44A away from the bottom inner surface of the spacer tray 22 to open the tray one-way exhaust passage so that the intake air can flow to the tray inside space 222. After the intake air flows through the membrane 44A, the membrane 44A recovers to have an airtight contact with the bottom inner surface of the spacer tray 22 to block the intake air from flowing back to the accommodating space 12.

Furthermore, as shown FIGS. 1 to 4, according to the vacuum container 100 of the embodiment of the present invention, the top cap 3 has a plurality of exhausting grooves 33. The exhausting grooves 33 are recessed from a bottom surface of the top cap 3 in a radially spaced manner around the exhausting hole 32. The exhausting grooves 33 communicate with the tray inside space 222 of the spacer tray 22.

As shown FIGS. 1 to 4, the one-way exhauster 4B mounted in the top cap 3 has a cylinder 41B, a bottom contact block 42B, a top cover part 43B and a membrane 44B. The cylinder 41B is inserted in the exhausting hole 32 of the top cap 3, a flowing clearance is formed between an outer surface of the cylinder 41B and the top cap 3, and the flowing clearance communicates with the exhausting grooves 33. The bottom contact block 42B is arranged at a bottom portion of the cylinder 41B and in contact with the bottom surface of the top cap 3 to cover the exhausting grooves 33. The top cover part 43B is arranged at a top portion of the cylinder 41B and disposed between the exhausting hole 32 and the outside space. The membrane 44B extends downward from a rim of the top cover part 43B in an inclined angle with respect to the top cover part 43B, and is in airtight contact with a top surface of the top cap 3, thereby forming, together with the top cap 3 and the top cover part 43B, a temporary chamber communicating with the flowing clearance.

As shown FIGS. 1 to 4, the exhaust air from the tray inside space 222 compressed by the pressing part 31 of the top cap 3 flows through the exhausting grooves 33, the flowing clearance and the temporary chamber and pushes the membrane 44B away from the top surface of the top cap 3 to open the cap one-way exhaust passage so that the exhaust air can flow to the outside space. After the exhaust air flows through the membrane 44B, the membrane 44B recovers to have an airtight contact with the top surface of the top cap 3 to block the outside air flowing back to the tray inside space 222.

As shown FIGS. 1 to 3, according to the vacuum container 100 of the embodiment of the present invention, the top cap 3 further has a spacer groove 34. The spacer groove 34 is recessed in the top cap 3 and is formed to surround, together with the exhausting hole 32, the pressing part 31 so that the pressing part 31 of the top cap 3 is easy to collapse and deform by pressing the pressing part 31.

As shown FIGS. 1, 2 and 5, according to the vacuum container 100 of the embodiment of the present invention, the top cap 3 has a vent hole 35. The vent hole 35 is formed passing through the top cap 3 and located in the pressing part 31. The vent hole 35 communicates with the outside space and the tray inside space 222. In the embodiment of the present invention, by pressing the top cap 3 while blocking the vent hole 35, the top cap 3 collapses to deform so as to exhaust the exhaust air to the outside space by compression of the tray inside space 222. After releasing the pressing operation of the pressing part 31, the vent hole 35 is open and the tray inside space 222 will have an atmospheric pressure the same as the outside space.

The vacuum container 100 of the embodiment of the present invention only comprises the storage container 1, the connecting tray component 2, the top cap 3 and the two one-way exhausters 4A, 4B such that the overall assembly structure of the vacuum container 100 is relative simple, and thus easy to disassemble and assemble, which is conducive to cleaning of the vacuum container 100.

Furthermore, by pressing the pressing part 31 of the top cap 3, the exhaust air from the tray inside space 222 is exhausted through the cap one-way exhaust passage to the outside space, the intake air from the accommodating space 12 flows through the tray one-way exhaust passage to the tray inside space 222, and therefore the accommodating space 12 of the storage container 1 becomes in the state approaching vacuum. In detail, the vacuum state of the accommodating space 12 can be released simply by holding the holding tab 212 to pull the connecting ring 21 away from the top portion of the storage container 1 to flow the outside air into the accommodating space 12.

The above description is merely the explanation of the preferred embodiment of the present invention. The ordinary person skilled in the art can apply other adjustments according to the claims below and the above description. However, the adjustments still belong to the technical concept of the present invention and fall into the claims of the present invention.

What is claimed is:

1. A vacuum container, comprising:

a storage container having a container opening and an accommodating space communicating with each other, wherein the container opening is formed on a top portion of the storage container such that an object to be preserved passes through the container opening to get into the accommodating space;

a connecting tray component having a tray opening, a tray inside space and a guiding hole, wherein the tray opening is formed on a top portion of the connecting tray component and communicates with the tray inside space, the guiding hole is formed passing through the connecting tray component, and the connecting tray component air-tightly encloses the container opening to seal the accommodating space;

a top cap having a pressing part, wherein the top cap is flexible such that the top cap is pressed to collapse and deform, the top cap encloses the tray opening to seal the tray inside space in a manner that the pressing part is in a position corresponding to the tray opening of the connecting tray component, and the top cap has an exhausting hole passing through the top cap; and two one-way exhausters, wherein one of the one-way exhausters is inserted in the guiding hole to mount in the connecting tray component thereby forming a tray one-way exhaust passage communicating the accommodating space of the storage container and the tray inside space of the connecting tray component, and another one-way exhauster is inserted in the exhausting hole to mount in the top cap thereby forming a cap one-way exhaust passage communicating the tray inside space and an outside space;

wherein when the pressing part of the top cap is pressed to collapse and deform toward the tray inside space, the tray inside space is compressed by the pressing part and exhausts an exhaust air through the cap one-way exhaust passage to the outside space, and then the accommodating space is driven by a pressure difference between the tray inside space and the accommodating space to exhaust through the tray one-way exhaust passage to the tray inside space so that the accommodating space becomes in a state approaching vacuum, and the pressing part resiliently recovers due to an intake air to the tray inside space.

2. The vacuum container as claimed in claim 1, wherein the connecting tray component has a connecting ring, a spacer tray and a top ring, the connecting ring is ring-shaped and has a down extending part and a receiving part, the down extending part is formed extending from a bottom portion of the connecting ring in a circular manner, the receiving part is arranged at a top portion of the connecting ring, the receiving part is in position corresponding to the top portion of the storage container, and the down extending part is in tight contact with an inner surface of the storage container so that the connecting ring is air-tightly mounted on the top portion of the storage container, the tray opening is formed on a top portion of the spacer tray, the tray inside space is formed inside the spacer tray, the guiding hole is formed passing through a bottom base of the spacer tray thereby mounting the one-way exhauster in the guiding hole, and the spacer tray has a contact part, the contact part is ring-shaped and disposed between the top portion of the spacer tray and the bottom base to form a stair like structure together with the top portion of the spacer tray and the bottom base, wherein the contact part is in tight contact with the receiving part of the connecting ring, and an outer surface of the spacer tray is arranged opposite to an inner surface of the connecting ring, and the outer surface of the spacer tray is arranged between the contact part and the bottom base, the top portion of the top ring is in tight contact with the top cap, and a bottom surface of the top ring is in tight contact with the top portion of the spacer tray, wherein the bottom portion of the connecting ring is in airtight contact with the top portion of the storage container to air-tightly enclose the container opening of the storage container with the spacer tray and the top ring, when the connecting ring is pulled in a manner away from the top portion of the storage container, an outside air from the outside space flows into the accommodating space.

3. The vacuum container as claimed in claim 2, wherein the connecting ring of the connecting tray component further has a holding tab, the holding tab is formed extending downward from an outer surface of the connecting ring, and the holding tab is provided to be held to facilitate pulling the connecting ring away from the top portion of the storage container.

4. The vacuum container as claimed in claim 2, wherein the connecting ring of the connecting tray component further has a through hole, the through hole is formed passing through the down extending part so that two ends of the through hole are in a position corresponding to the inner surface of the storage container and the spacer tray, respectively so that the outside air in advance passes through the through hole to flow into the accommodating space of the storage container when the connecting ring is pulled upward slightly thereby preventing from pulling upward the connecting ring too high.

5. The vacuum container as claimed in claim 2, wherein the top ring of the connecting tray component further has an extensional part, the extensional part is ring-shaped and formed extending downward from a bottom portion of the top ring to dispose in a top inner surface of the spacer tray, the top cap further has a bottom extending part, the bottom extending part is ring-shaped and is formed protruding from the bottom surface of the top cap, and the bottom extending part further has a plurality of transverse strips, the transverse strips are arranged to be spaced apart from each other and transversely protrude from an outer surface of the bottom extending part, wherein the bottom surface of the top cap, which abuts to a rim of the top cap, is in tight contact with a top surface of the top ring, the bottom extending part of the top cap is in tight contact with an inner surface of the top ring, and the transverse strips are in tight contact with the extensional part of the top ring thereby forming an airtight connection between the top ring and the top cap.

6. The vacuum container as claimed in claim 2, wherein the spacer tray of the connection tray component has a plurality of guiding grooves, the guiding grooves are recessed from a bottom outer surface of the spacer tray in a radially spaced manner around the guiding hole, the guiding grooves communicate with the accommodating space of the storage container, the one-way exhauster mounted in the spacer tray has a cylinder, a bottom contact block, a top cover part and a membrane, the cylinder is inserted in the guiding hole of the spacer tray, a flowing clearance is formed between an outer surface of the cylinder and the bottom base of the spacer tray, and the flowing clearance communicates with the guiding grooves, the bottom contact block is arranged at a bottom portion of the cylinder and in contact with the bottom outer surface of the spacer tray to cover the guiding grooves, the top cover part is arranged at a top portion of the cylinder and disposed in the tray inside space of the spacer tray, the membrane is formed extending downward from a rim of the top cover part and at an inclined angle to the top cover part, and is in airtight contact with a bottom inner surface of the spacer tray, thereby forming, together with the spacer tray and the top cover part, a temporary chamber communicating with the flowing clearance, wherein the intake air from the accommodating space driven by the pressure difference between the tray inside space and the accommodating space flows through the guiding grooves, the flowing clearance and the temporary chamber and pushes the membrane away from the bottom inner surface of the spacer tray to open the tray one-way exhaust passage to flow the air to the tray inside space, after the intake air flows through the membrane, the membrane recovers to have an airtight contact with the bottom inner surface of the spacer tray to block the intake air from flowing back to the accommodating space.

7. The vacuum container as claimed in claim 2, wherein the top cap has a plurality of exhausting grooves, the exhausting grooves are recessed from a bottom surface of the top cap in a radially spaced manner around the exhausting hole, the exhausting grooves communicate with the tray inside space of the spacer tray, the one-way exhauster mounted in the top cap has a cylinder, a bottom contact block, a top cover part and a membrane, the cylinder is inserted in the exhausting hole of the top cap, a flowing clearance is formed between an outer surface of the cylinder and the top cap, and the flowing clearance communicates with the exhausting grooves, the bottom contact block is arranged at a bottom portion of the cylinder and in contact with the bottom surface of the top cap to cover the exhausting grooves, the top cover part is arranged at a top portion of the cylinder and disposed between the exhausting hole and the outside space, the membrane extends downward from a rim of the top cover part in an inclined angle with respect to the top cover part, and is in airtight contact with a top surface of the top cap, and the membrane is together with the top cap and the top cover part to form a temporary chamber communicating with the flowing clearance, wherein the exhaust air from the tray inside space compressed by the pressing part of the top cap flows through the exhausting grooves, the flowing clearance and the temporary chamber and pushes the membrane away from the top surface of the top cap to open the cap one-way exhaust passage to flow the air to the outside space, after the exhaust air flows through the membrane, the membrane recovers to have an airtight contact with the top surface of the top cap to block the outside air flowing back to the tray inside space.

8. The vacuum container as claimed in claim 1, wherein the top cap further has a spacer groove, the spacer groove is recessed in the top cap and is formed to surround, together with the exhausting hole, the pressing part so that the pressing part of the top cap is easy to collapse and deform by pressing the pressing part.

9. The vacuum container as claimed in claim 1, wherein the top cap has a vent hole, the vent hole is formed through the top cap and located in the pressing part, the vent hole communicates with the outside space and the tray inside space, wherein by pressing the top cap while blocking the vent hole, the top cap collapses to deform so as to exhaust the exhaust air to the outside space by compression of the tray inside space, after releasing the pressing operation of the pressing part, the vent hole is open and the tray inside space will have an atmospheric pressure same as the outside space.

10. The vacuum container as claimed in claim 1, wherein the top cap has a vent hole, the vent hole is formed through the top cap and located in the pressing part, the vent hole communicates with the outside space and the tray inside space.

* * * * *